United States Patent [19]

Umino

[11] Patent Number: 4,495,695

[45] Date of Patent: Jan. 29, 1985

[54] APPARATUS FOR MANUFACTURING SLIDE FASTENER HAVING SEPARABLE END STOP

[75] Inventor: Mitsugu Umino, Toyama, Japan

[73] Assignee: Yoshida Kogyo K. K., Tokyo, Japan

[21] Appl. No.: 511,644

[22] Filed: Jul. 7, 1983

[30] Foreign Application Priority Data

Jul. 10, 1982 [JP] Japan ..... 57-120179

[51] Int. Cl.[3] ..... A41H 37/06; B21D 53/50

[52] U.S. Cl. ..... 29/767; 29/33.2; 29/408

[58] Field of Search ..... 29/33.2, 766, 767, 768, 29/769, 408, 409, 410

[56] References Cited

U.S. PATENT DOCUMENTS 4,122,594 10/1978 Azzara ..... 29/768

4,131,993 1/1979 Azzara ..... 29/768

*Primary Examiner*—Howard N. Goldberg

*Assistant Examiner*—Steven E. Nichols

*Attorney, Agent, or Firm*—Hill, Van Santen, Steadman & Simpson

[57] ABSTRACT

Disclosed herein is an apparatus for producing a slide fastener having a separable end stop through the steps of attaching a pin, box pin, a slider and a box to a pair of stringers while the stringers are being fed in a parallel state by grippers, in which the stringers have a space portion devoid of fastener elements and upper stoppers affixed adjacent to the space portion. A slider attaching unit of this apparatus has a transfer holder for carrying the slider into the path of travel of the stringers from a slider supply device and a retaining device for retaining the slider between itself and the holder. The retaining device includes a stopper block and an engaging block which are driven so as to assume positions where both blocks cooperate with the transfer holder to retain the slider when the stringers are passed through the slider, after which the stopper block is driven so as to separate from the slider, whereby the slider is freed from between the transfer holder and engaging block automatically when the upper stoppers of the stringers engage the slider.

3 Claims, 11 Drawing Figures

APPARATUS FOR MANUFACTURING SLIDE FASTENER HAVING SEPARABLE END STOP

BACKGROUND OF THE INVENTION

This invention relates to an apparatus for automatically manufacturing a slide fastener having a separable end stop.

In the prior art, there is a known apparatus for automatically attaching a pin, box pin, slider and box to a pair of stringers having a space portion devoid of fastener elements and upper stoppers affixed adjacent to the space portion. An example of such apparatus is disclosed in the specification of Japanese Patent Publication No. 49-44243. In such apparatus, however, the pin is attached to one of the stringers and the box pin, box and slider are attached to the other. To obtain a final product, therefore, the two stringers must be combined by hand.

SUMMARY OF THE INVENTION

It is an object of the present invention to provide an apparatus capable of automatically fabricating a slide fastener having a separable end stop, which slide fastener is obtained in the form of a final product wherein the two stringers are combined and the slider is pulled completely up to the position of the upper stops.

The apparatus of this invention produces a slide fastener having a separable end stop through the steps of attaching a pin, a box pin, a slider and a box to a pair of stringers while the stringers are being fed in a parallel state by grippers, in which the stringers have a space portion devoid of fastener elements and upper stoppers affixed adjacent to the space portion. The apparatus of the invention comprises a pin fitting attaching unit for attaching the pin and box pin to the core portions of the stringers, a slider attaching unit, and a box attaching unit for attaching the box to the box pin. The pair of stringers are fed so as to pass through the pin attaching unit, the slider attaching unit and the box attaching unit. The slider attaching unit has a transfer holder for carrying the slider into the path of travel of the stringers from a slider supply device and a retaining device for retaining the slider between itself and the holder. The retaining device includes a stopper block having a portion for embracing the slider between itself and the transfer holder and a shoulder portion for impeding movement of the slider in the travelling direction of the stringers, as well as an engaging block having a portion for embracing the slider between itself and the transfer holder, these two blocks being driven so as to assume positions where both blocks cooperate with the transfer holder to retain the slider when the stringers are passed through the slider, after which the stopper block is driven so as to separate from the slider, whereby the slider is freed from between the transfer holder and engaging block automatically when the upper stoppers of said stringers engage the slider.

BRIEF DESCRIPTION OF THE DRAWINGS

Other objects and advantages of the invention will become clear from the following description of an embodiment of the invention referring to the drawings, in which.

DETAILED DESCRIPTION OF THE INVENTION

Figure 1:
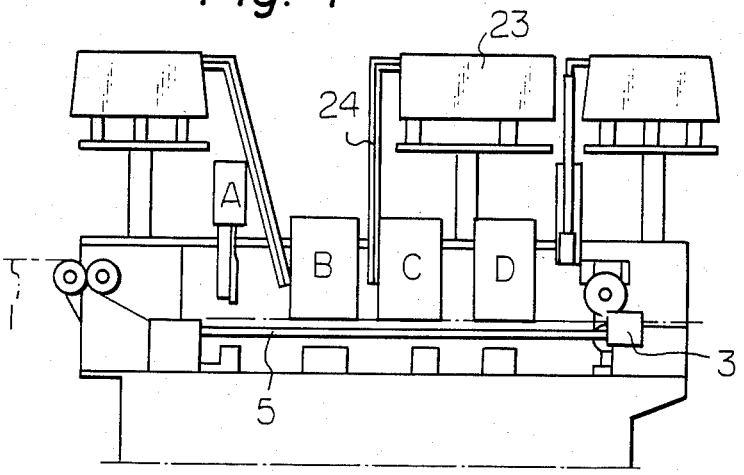
FIG. 1 is a schematic illustration showing the overall structure of an apparatus for manufacturing a slide fastener having a separable end stop in accordance with the present invention.

FIG. 1 shows, in simplified form, the overall apparatus for manufacturing a slide fastener having a separable end stop in accordance with the present invention. A pair of fastener stringers 1, 2, located left and right, are fed from the left side of the drawing (only the fastener stringer 1 being illustrated in the drawing), the stringers being disposed in parallel in a substantially horizontal plane as they are fed. These stringers are provided intermittently with element-free space portions for partitioning a continuous row of elements into the lengths of the final products. Upper stoppers are mounted at the rear end of the element rows contiguous to the space portion. These continuous stringers 1, 2 are gripped at the tape portions thereof by grippers, described later, whereby the stringers are moved through a cutting unit A, a pin fitting attaching unit B, a slider attaching unit C and a box attaching unit D. In the pin fitting attaching unit B, a pin and a box pin are attached to the end of each stringer. In the slider attaching unit, the two stringers are passed through the interior of a slider simultaneously to be combined into a fastener chain, in a manner to be described later. In the box attaching unit D, a box is attached to the pin and box pin and, in the cutting unit A, a space portion is severed to give a length of the final product. It should be noted that the cutting step may be performed at any time before or after the steps executed by the aforesaid units B, C and D, depending upon the product length. The units A, B and D may consist of known mechanisms capable of performing the desired functions described above.

Figure 2:
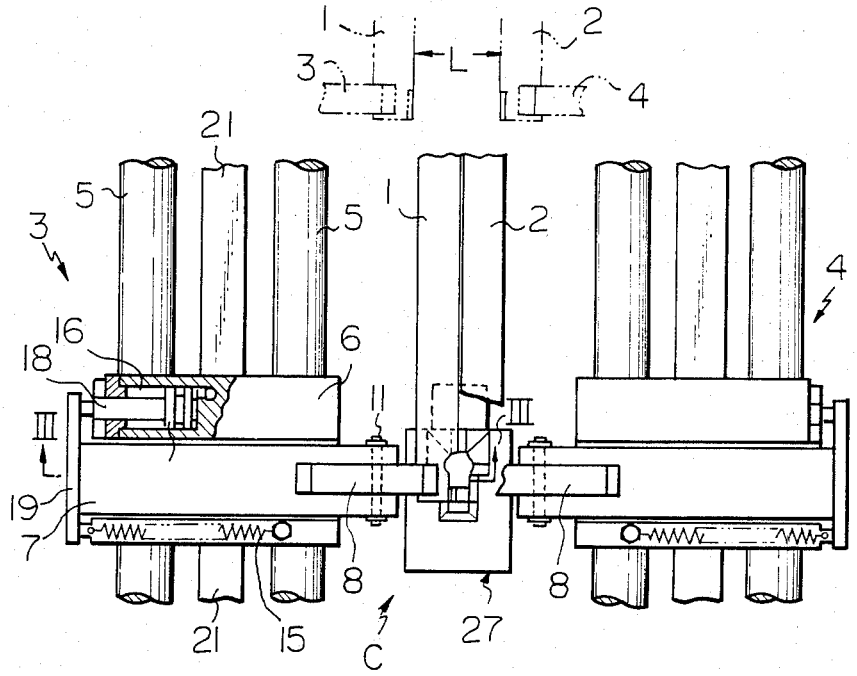
FIG. 2 is a plan view showing grippers in a slider attaching unit of the apparatus shown in FIG. 1.
Figure 3:
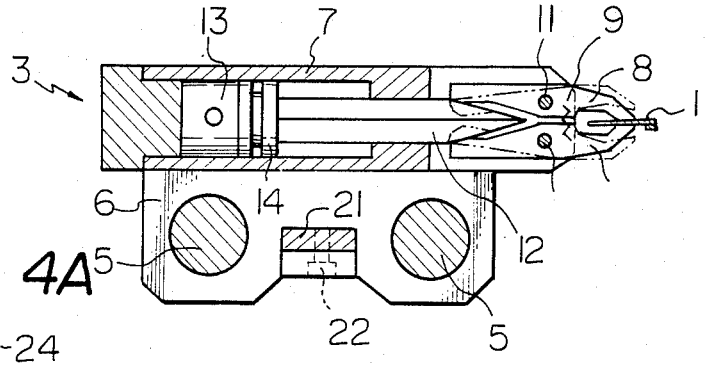
FIG. 3 is a sectional view showing the structure of one of the grippers shown in FIG. 2.

As shown in FIG. 2, a pair of grippers, left and right, namely a first gripper 3 and a second gripper 4, are provided. Since these grippers are of the same construction, the following description is directed to the gripper 3, but applies also to the gripper 4. The gripper 3 comprises a slide base 6 slidable along guide rails 5 extending lengthwise of the slide fastener manufacturing apparatus, a gripper base 7 mounted for sliding movement transversely of the slide base, and a pair of grip pieces 8, upper and lower, mounted on the gripper base for pivotal movement via pins 11. The grip pieces 8 are biased in the opening direction at all times by a compression spring 9, but are pivoted about the pins 11, so as to close, owing to rightward movement of a wedge rod 12 in FIG. 3, the wedge rod engaging with the rear ends of the grip pieces. The wedge rod 12 is connected to a piston 14 slidably accommodated in a fluid cylinder 13 formed within the gripper base 7. The grip pieces can be opened or closed at any desired time by controlling the fluid supplied to the cylinder 13, thereby gripping and releasing the stringer 1.

The gripper base 7 is biased toward the stringer 1 by a tension spring 15, but can be displaced to the left in FIG. 1 at any desired time owing to the fact that the gripper base 7 is connected through a piston rod 18 and a connecting plate 19 to a piston 17 accommodated within a fluid cylinder 16, which is formed in the slide base 6. In this manner, the spacing between the grippers 3 and 4 is adjusted so that, at the initial stage of gripping the stringers 1, 2, the first and second grippers grip only the tape portions of these stringers, and so that the stringers will assume a distance best suited for the operations to be carried out in the ensuing steps.

The slide base 6 is mounted by means of a screw 22 to a belt 21 driven by a suitable driving device, whereby the slide base is slid along the two parallel guide rails 5.

The slider attaching unit C has a transfer holder 26 for carrying a slider 25 (FIG. 4), which is delivered from a slider feeder 23 (FIG. 1) via a chute 24, into the path of travel of the stringers, and a retaining device 27 for retaining the slider between itself and the transfer holder. The transfer holder 26 has the construction shown in FIGS. 5A through 5C, in which numeral 28 denotes the holder proper, which may be swung between a position (indicated by the dot-and-dash line) for receiving the slider 25 from the chute 24, and a position (indicated by the solid line) for disposing the slider in the path of travel of the stringers. The holder proper 28 is provided with a clamper holder 29 movable relative thereto, the clamper holder being driven up and down in FIG. 5A by a piston rod 31. Two clampers 32 are pivotally attached to the lower end of the clamper holder 29 by pins 33 and are pulled toward each other by a tension spring 34. Provided between the clampers 32 is a stationary rod 36 secured to the holder proper 28. The clampers are held in the attitude indicated by being brought into contact with the stationary rod. The lower ends of the clampers 32 are so configured as to define an opening 35 for receiving the slider 25 received from the chute 24. After the opening 35 has received the slider 25, this being performed in the position indicated by the dot-and-dash line in FIG. 5A, the transfer holder 26 is swung to the position indicated by the solid line where the slider is retained between the retaining device 27, described later, and the stationary rod 36. Thereafter, the clamper holder 29 is raised by the piston rod 31, causing the clampers 32 to swing outwardly and release the slider 25. The slider thus is retained solely by the stationary rod 36 and retaining device 27.

FIGS. 4A through 4E show the details of the retaining device 27. As illustrated, the retaining device has a holder case 37 which is positioned centrally of the two stringers. The holder case 37 is formed to include a longitudinal bore 38 within which there are slidably provided a stopper block 43 and an engaging block 44 moved up and down independently of each other by respective piston rods 41, 42 of two fluid cylinders. Formed between these two blocks is a slit 46 for accommodating a pull-tab 45 of the slider 25. The upper part of the stopper block is formed to include a slider receiving surface 47, which is a portion for embracing the slider 25 between itself and the stationary rod 36 of the transfer holder 26, a shoulder portion 48 for impeding movement of the slider in the direction of stringer advance, and a stopper portion 49 for aligning the ends of the pin and the box pin of the stringers 1, 2.

The engaging block is bifurcated at the upper part thereof to form two finger-shaped columns. Pivotally attached within the slot between the two finger-shaped columns by means of a pin 52 is an engaging lever 51 capable of being projected into the slit 46. The engaging lever 51 is biased by a compression spring 53 so that the distal end thereof will be projected into the slit 46. A rod 55 of a solenoid 54, however, which is provided on the back surface of the engaging block 44, is thrust toward the lower end portion of the engaging lever 51 by energizing the solenoid, whereby the distal end of the engaging lever is held in position clear of the slit 46. The engaging block 44 is so adapted that the upper surface 56 thereof will cooperate with the stationary rod 36 to embrace the slider 25.

Figure 4A:
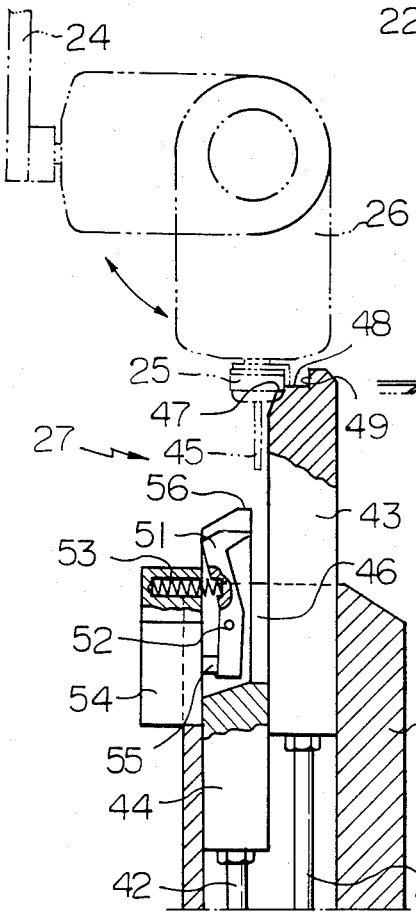
FIGS. 4A through 4E are sectional views illustrating, step by step, the operation of a slider retaining device.
Figure 4B:
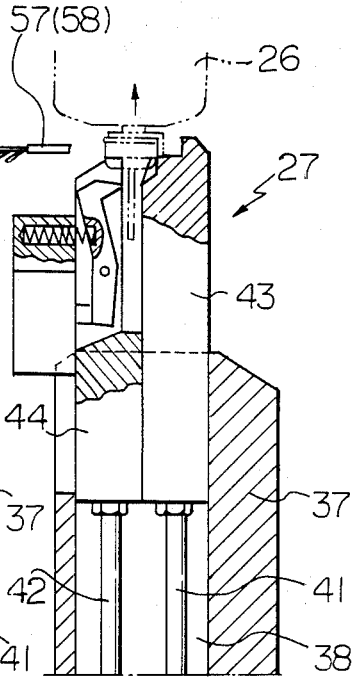
Figure 4C:
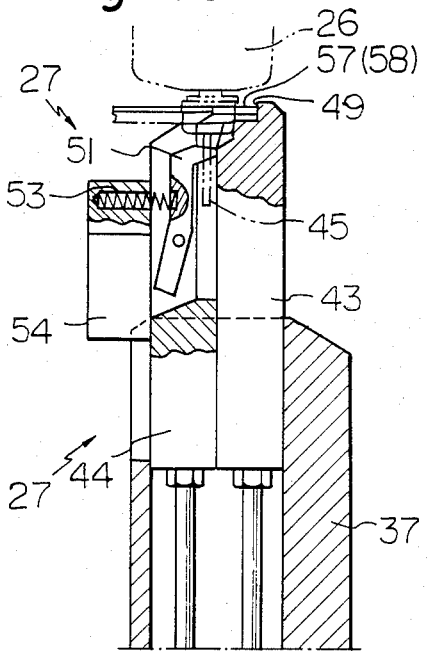
Figure 4D:
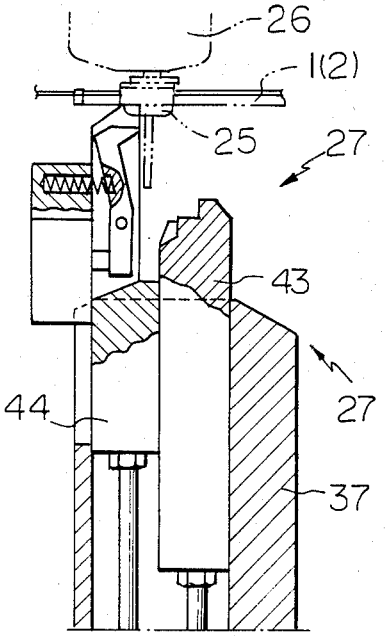
Figure 4E:
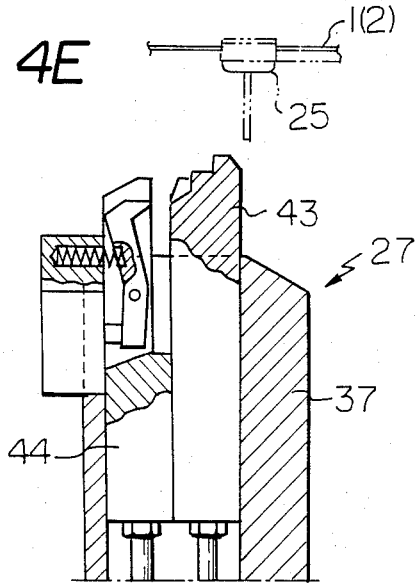

The operation of the illustrated embodiment will now be described, The stringers 1, 2, having the pin and box pin which have been attached in the pin fitting attaching unit B are gripped and delivered to the slider attaching unit C by the grippers 3, 4 while in a widely separated state, indicated by L in FIG. 2. By the time the latter attaching unit is reached, however, the fluid is discharged from the fluid cylinder 16 of the slide base 6, whereby the gripper bases 7 are displaced toward each other by the action of the spring 15, thereby reducing the spacing between the stringers 1, 2 to that suitable for passing the stringers through the slider 25. Before the leading ends of the stringers arrive at the slider attaching unit C, the slider 25 is held in the path of travel of the stringers 1, 2 through the steps illustrated in FIGS. 4A through 4C, and the stringers 1, 2 are passed through the slider, held in this state, as shown in FIGS. 4C through 4E. These steps will be described hereinafter. In the following, the steps (a) through (e) correspond to FIGS. 4A through 4E.

Figure 5A:
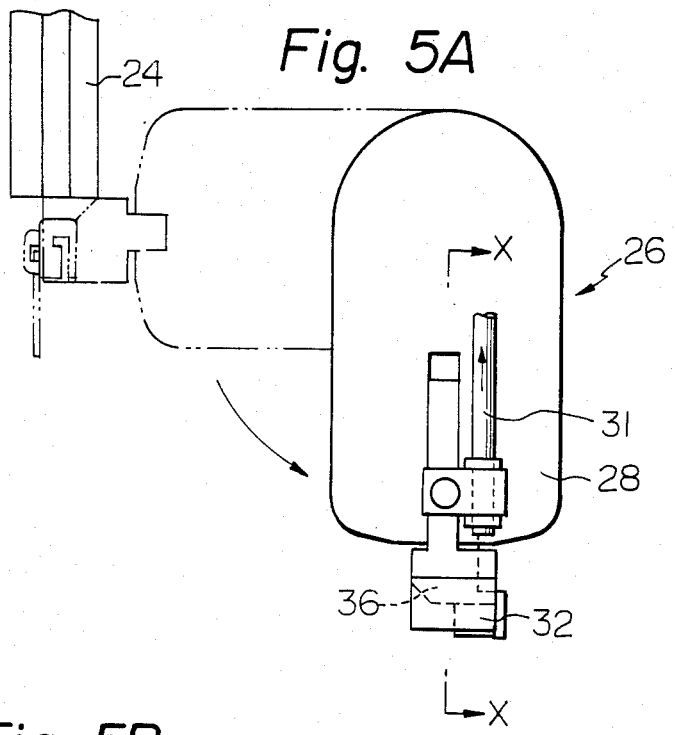
FIG. 5A is a side elevation of a transfer holder for sliders.
Figure 5B:
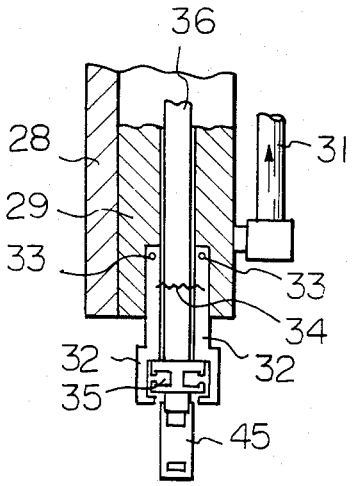
FIG. 5B is a sectional view, taken along the line X—X of FIG. 5A, illustrating the structure of the transfer holder in detail.
Figure 5C:
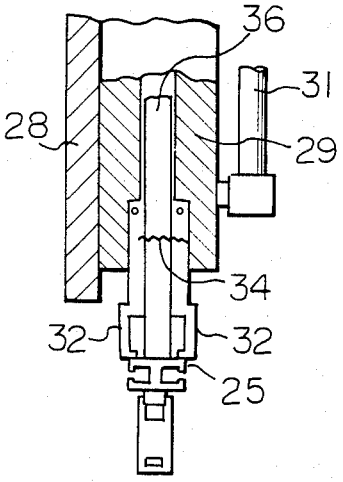
FIG. 5C is a sectional view similar to that of FIG. 5B but illustrating a different operating position.

(a) First, with the stopper block 43 in the raised state, the transfer holder 26, which has received the slider 25 from the chute 24, is swung into the position indicated by the solid line in FIG. 5A, and the clamper holder 29 is raised in the manner described above, whereby the slider 25 is embraced and retained by the stationary rod 36 and the slider receiving surface 47 of the stopper block 43.

(b) Next, the engaging block 44 is raised until the upper surface 56 thereof contacts the slider 25, with the pull-tab 45 depending from the body of the slider into the slit 46 which is formed at this time. At this particular time, the slider 25 is retained by three elements, namely the transfer holder 26, stopper block 43 and engaging block 44.

(c) The solenoid 54 is now energized, whereupon the rod 55 is pulled inwardly to permit the upper end of the engaging lever 51 to be projected into the slit 46 by the action of the compression spring 53. The upper end of the engaging lever 51 thus engages with an opening (not shown) provided in the pull-tab 45 of the slider 25, applying a downwardly directed force to the pull-tab. This force further assures retention of the slider. In addition, in the case of a locking-type slider, namely one in which a locking claw is fit between fastener elements internally of the slider to lock the slider unless a force is applied to the pull-tab, the above-mentioned force tensions the pull-tap to release the lock, making it possible for the stringers to be passed through the interior of the slider. In this state, the stringers 1, 2 having the pin 57 and box pin 58 on the respective leading ends thereof are passed through the interior of the slider 25, after which the leading ends of these pins are brought into abutting contact with the stopper portion 49, thereby coming to a halt. Thus, the relative positions of the pin 57 and box pin 58 are regulated in an accurate manner.

(d) Next, the solenoid 54 is energized to separate the upper end portion of the engaging lever 51 from the pull-tab 45 of the slider, and the stopper block 43 is lowered. As a result, the slider 25 is retained and embraced solely by the transfer holder 26 and the upper surface 56 of the engaging block 44. This is followed by resuming the transfer of the two stringers 1, 2 simultaneously at the same speed to feed the stringers forwardly as they are properly interlocked within the slider.

(e) When the upper stoppers affixed to the rear ends of the fastener element rows arrive at the position of the slider 25, the upper stoppers engage the shoulder openings of the slider so that the slider is forcibly pulled out from between the engaging block 44 and transfer holder 26, after which the engaging block is lowered and the transfer holder swung to the slider receiving position. The stopper block 43 is then raised to return to the state shown in FIG. 4A.

During the foregoing process, the box is attached to the box pin in the box attaching unit D and, as described above, the stringers are severed in the cutting unit A at any time, which will depend upon the length of the fastener end product. This completes the slide fastener.

In accordance with the foregoing construction, the apparatus of the present invention for manufacturing a slide fastener having a separable end stop makes it possible to manufacture the final product automatically, wherein the two stringers are combined while past through the slider and the slider of the final product is pulled up the full extent.

What is claimed is:

1. An apparatus for manufacturing a slide fastener having a separable end stop through the steps of attaching a pin, box pin, slider and box to a pair of stringers while the stringers are being fed in a parallel state by grippers, said stringers having a space portion devoid of fastener elements and upper stoppers affixed adjacent to the space portion, characterized in that said apparatus comprises a pin fitting attaching unit for attaching the pin and box pin to the core portions of the stringers, a slider attaching unit, and a box attaching unit for attaching the box to the box pin, said pair of stringers being fed so as to pass through said pin attaching unit, said slider attaching unit and said box attaching unit, said slider attaching unit having a transfer holder for carrying the slider into the path of travel of the stringers from a slider supply device, and a retaining device for retaining the slider between itself and said holder, said retaining device including a stopper block having a portion for embracing the slider between itself and the transfer holder, and a shoulder portion for impeding movement of the slider in the travelling direction of the stringers, as well as an engaging block having a portion for embracing the slider between itself and the transfer holder, these two blocks being driven so as to assume positions where both blocks cooperate with the transfer holder to retain the slider when the stringers are passed through the slider, after which the stopper block is driven so as to separate from the slider, whereby the slider is freed from between the transfer holder and engaging block automatically when the upper stoppers of said stringers engage the slider.

2. An apparatus for manufacturing a slide fastener having a separable end stop as claimed in claim 1, wherein said engaging block has means for tensioning a pull-tab of the slider accommodated between said block and the transfer holder.

3. An apparatus for manufacturing a slide fastener having a separable end stop as claimed in claim 1, wherein said stopper block further includes a stopper portion for alinging leading ends of the pin and box pin of the oncoming fed stringers.

* * * * *